US005727417A

United States Patent [19]

Moffatt et al.

[11] Patent Number: 5,727,417

[45] Date of Patent: Mar. 17, 1998

[54] PORTABLE BATTERY POWERED CRIMPER

[75] Inventors: W. Keith Moffatt, Freeport; Billy J. Bauscher, Loves Park; Richard Alan Zwicky, Jr., Rockford, all of Ill.

[73] Assignee: Greenlee Textron Inc., Rockford, Ill.

[21] Appl. No.: 532,332

[22] Filed: Sep. 22, 1995

[51] Int. Cl.[6] ..... B21D 9/18

[52] U.S. Cl. ..... 72/453.03; 72/453.16

[58] Field of Search ..... 72/453.15, 453.16, 72/453.06, 453.08, 453.02, 452.7, 452.4; 91/459; 324/426, 427, 435

[56] References Cited

U.S. PATENT DOCUMENTS

| | | | |
|---|---|---|---|
| 2,897,703 | 8/1959 | Fischer et al. | 72/453.16 |
| 4,132,107 | 1/1979 | Suganuma et al. | 72/453.16 |
| 4,226,110 | 10/1980 | Suganuma . | |
| 4,418,562 | 12/1983 | Sakai et al. | 72/452.5 |
| 4,541,266 | 9/1985 | Totsu | 72/449 |
| 4,932,237 | 6/1990 | Hatfield . | |
| 5,111,681 | 5/1992 | Yasui . | |
| 5,113,679 | 5/1992 | Ferraro et al. . | |
| 5,130,659 | 7/1992 | Sloan | 324/426 |
| 5,188,188 | 2/1993 | Mars | 30/394 |
| 5,195,354 | 3/1993 | Yasui et al. | 72/453.16 |
| 5,272,811 | 12/1993 | Armand | 72/453.15 |
| 5,282,378 | 2/1994 | Kimura | 72/453.15 |
| 5,371,682 | 12/1994 | Levine et al. | 324/426 |
| 5,406,266 | 4/1995 | Mino et al. | 324/425 |
| 5,483,727 | 1/1996 | Chang | 16/110 R |
| 5,545,969 | 8/1996 | Hasegawa | 324/427 |
| 5,550,475 | 8/1996 | Shafer | 324/427 |
| 5,565,782 | 10/1996 | Sato | 324/435 |
| 5,606,242 | 2/1997 | Hull et al. | 324/426 |
| 5,623,999 | 4/1997 | Linsbauer et al. | 16/110 R |

FOREIGN PATENT DOCUMENTS

| | | | |
|---|---|---|---|
| 3805-196-A | 8/1989 | Germany | 16/110 R |
| 9475 | 5/1901 | United Kingdom | 72/453.16 |

OTHER PUBLICATIONS

BATOOL Burndy Electrical promotional materials (2 pages).

BATOOL Series Battery Operated Tools Operating & Maintenance Instructions for BAT500, BAT 35, BAT 750, BAT 644M, BATCUT (11 pages).

Aircraft Dynamics ROBOTOOLS Battery Operated Equipment (7 pages).

Battery Operated Pump Y700DC-1 Burndy Electrical (2 pages).

Sperry Vickers, Industrial Hydraulics Manual, pp. 11-25 to 11-30 and figures 11-30 and 11-35, Sep. 1970.

*Primary Examiner*—David Jones
*Assistant Examiner*—John Paradiso
*Attorney, Agent, or Firm*—Trexler, Bushnell, Giangiorgi & Blackstone, Ltd.

[57] ABSTRACT

A hydraulic drive tool such as a crimping apparatus which includes a crimp head assembly and a body portion which are arranged in an axially elongated configuration to balance a grip area of the apparatus along the center of gravity of the apparatus. The crimping apparatus includes a hydraulic drive assembly having a wobble plate. The hydraulic drive assembly has an axially oriented piston arrangement in a hydraulic head to position an axially arranged configuration of the hydraulic drive assembly along a central axis of the apparatus. The wobble plate is configured to provide axially displaced, non-rotational, generally linear movement of a wobble ring to transfer reciprocal movement to pistons retained in the hydraulic block. The apparatus is configured with the hydraulic drive assembly centrally positioned in the body portion with the crimping head assembly at one end and a battery power source at an opposite end. The apparatus provides a retract device which automatically operates to retract a hydraulic ram of the crimp head assembly a predetermined distance. The crimping apparatus provides a method of crimping which allows the operator to place the apparatus on a crimp article, crimp the article, automatically activate the retract device to disengage the head from the formed crimp, reposition the crimp head in a subsequent location for crimping and activate the apparatus to produce the next crimp.

20 Claims, 6 Drawing Sheets

20
22
28
30
32
34
36
38
40
42
44
46
48
50
54
60°
69
108
114
116
126
128
130
132
134
136
138
140
142
144
146
147
148
149
152
154
157
159
160
24
26

PORTABLE BATTERY POWERED CRIMPER

BACKGROUND

The present invention relates to battery powered, portable, hydraulic compressing tools such as crimping apparatus for use in making crimp formed connections.

A variety of apparatus have been developed which use hydraulic systems for developing compressive forces to compress metal connectors around elements, such as wires or cables, to be connected. Such devices, referred to generally as "crimping apparatus" or "crimpers", have been provided in a variety of forms for use in the field. Some crimping apparatus are dependent upon a service vehicle or other equipment, such as a hydraulic basket arm ("cherry picker"), reducing the portability and flexibility of use of the crimping apparatus.

It is desirable to provide crimping apparatus which is portable and capable of producing substantial crimping pressures (approximately 12 tons of force) in order to provide desired crimped connections on larger cable elements. In response to this need, portable, battery-operated, motor assisted hydraulic crimping apparatus have been produced. The currently available portable, battery-operated, crimping apparatus, however, does not satisfy all of the needs in order to efficiently, expeditiously, and safely execute crimping operations.

Prior art crimping apparatus are awkward because they weigh approximately 10–20 pounds and are arranged in a pistol-type configuration. The pistol-type configuration makes it difficult to handle and control the relatively heavy devices. These crimping apparatus includes a crimping head connected to a hydraulic drive apparatus and some form of battery device to provide power to the hydraulic apparatus. The battery assembly is heavy due to the weight of the power cells in the battery to provide sufficient charge over a sufficient length of time to make a portable battery operated crimping apparatus practical. The hydraulic drive portion is typically formed of a heavy casting in order to withstand the rather substantial pressures which are developed therein to drive the crimping head. Additionally, the crimping head may be quite heavy in order to provide a sufficiently stable and strong crimping die to perform the necessary crimping operations.

The pistol-type configuration of the prior art crimping apparatus is not the most ergonomically desirable because it cannot not be balanced comfortably in the operator's hand. This problem is exacerbated in view of the fact that the tradesperson must pick-up, hold, and repeatedly manipulate such a crimping apparatus with one hand numerous times throughout the day. The 10–20 pounds of weight may be burdensome and fatiguing to use throughout a day of performing such crimping operations. Additionally, the pistol-type configuration substantially relies on the smaller, weaker muscle groups of the wrist to operate and position the crimping apparatus and does not maximize the use of the large muscle groups in the arms.

As an additional consideration, the crimping apparatus requires a hand-operated control in order to activate the crimping apparatus when it is positioned over a crimping lug or connector. Although the prior art pistol-type crimpers have tried to balance the crimping head and battery by placing these components at opposite ends of a grip portion, they still rely upon a pistol-type configuration. Weight is unevenly distributed in the pistol-type configuration and tends to pull forwardly on the operator's hand. Further, at least one and usually two pistol-type trigger switches are located on the grip portion for operation of the crimper. The use of such trigger switches places the weight and gripping forces on the thumb and lower two fingers so that the index and middle finger may be used to operate the trigger switches. This is a further burden on the tradesperson.

Another form of prior art crimper places the crimper handle and switches at one end of a body and the crimper head at an opposite end of the body. This device, which also weighs 10–20 pounds, requires two hands to position and operate. One hand is positioned underneath the body to carry the weight and locate the crimper head on a crimp connector while the other hand is positioned on the handle to operate the switches. While this elongated configuration may reduce some problems associated with the pistol-type crimping apparatus, it creates other problems because it must be operated with two hands.

It should also be noted that the elongated version is advantageous in that two hands may be used in order to reduce the fatigue on a single hand. Whereas with the pistol-type crimping apparatus two hands generally cannot be used since a second hand placed on the apparatus may be positioned too close to the crimp head. Positioning a second hand too close to the crimp head in a pistol-type crimping apparatus may increase the risk of injury.

Further, the prior art crimping devices encounter a problem such that they do not allow easy and efficient operation of the crimping apparatus to expedite crimping operations. More particularly, prior art crimping apparatus typically engage a crimp and then disengage the crimp. An operator must disengage the crimp and move it along a crimping article in order to provide a series of crimps along an elongated article. As such, it would be desirable to provide a crimping apparatus which automatically retracts or disengages the crimping article a predetermined mount so as to improve the efficiency of the crimping operation.

OBJECTS AND SUMMARY

A general object satisfied by the claimed invention is to provide a crimping apparatus which includes a hydraulic drive assembly which can quickly and efficiently operate a crimp head to perform a crimping operation.

Another object satisfied by the claimed invention is to provide a crimping apparatus which is generally balanced to reduce fatigue in handling the crimping apparatus.

Still a further object of the present invention is to provide a crimping apparatus which includes a device which retracts the crimping head for allowing the crimping apparatus to be moved along a crimp article in order to quickly and efficiently perform a series of crimping operations on the same crimp article.

Yet a further object of the present invention is to provide a crimping apparatus which provides a system to determine whether there is sufficient battery power to complete a crimping cycle once a crimp is initiated.

Briefly, and in accordance with the foregoing, the present invention envisions a hydraulic drive tool such as a crimping apparatus which includes a crimp head assembly and a body portion which are arranged in an axially elongated configuration to balance a grip area of the apparatus along the center of gravity of the apparatus. The crimping apparatus includes a hydraulic drive assembly having a wobble plate. The hydraulic drive assembly has an axially oriented piston arrangement in a hydraulic head to position an axially arranged configuration of the hydraulic drive assembly along a central axis of the apparatus. The wobble plate is configured to provide axially displaced, non-rotational, generally linear movement of a wobble ring to transfer reciprocal movement to pistons retained in the hydraulic block. The apparatus is configured with the hydraulic drive assembly centrally positioned in the body portion with the crimping head assembly at one end and a battery power source at an opposite end. The apparatus provides a retract device which automatically operates to retract a hydraulic ram of the crimp head assembly a predetermined distance. The crimping apparatus provides a method of crimping which allows the operator to place the apparatus on a crimp article, crimp the article, automatically activate the retract device to disengage the head from the formed crimp, reposition the crimp head in a subsequent location for crimping and activate the apparatus to produce the next crimp.

BRIEF DESCRIPTION OF THE DRAWINGS

The organization and manner of the structure and function of the invention, together with further objects and advantages thereof, may be understood by reference to the following description taken in connection with the accompanying drawings, wherein like reference numerals identify like elements, and in which.

DESCRIPTION

Figures 1, 2:
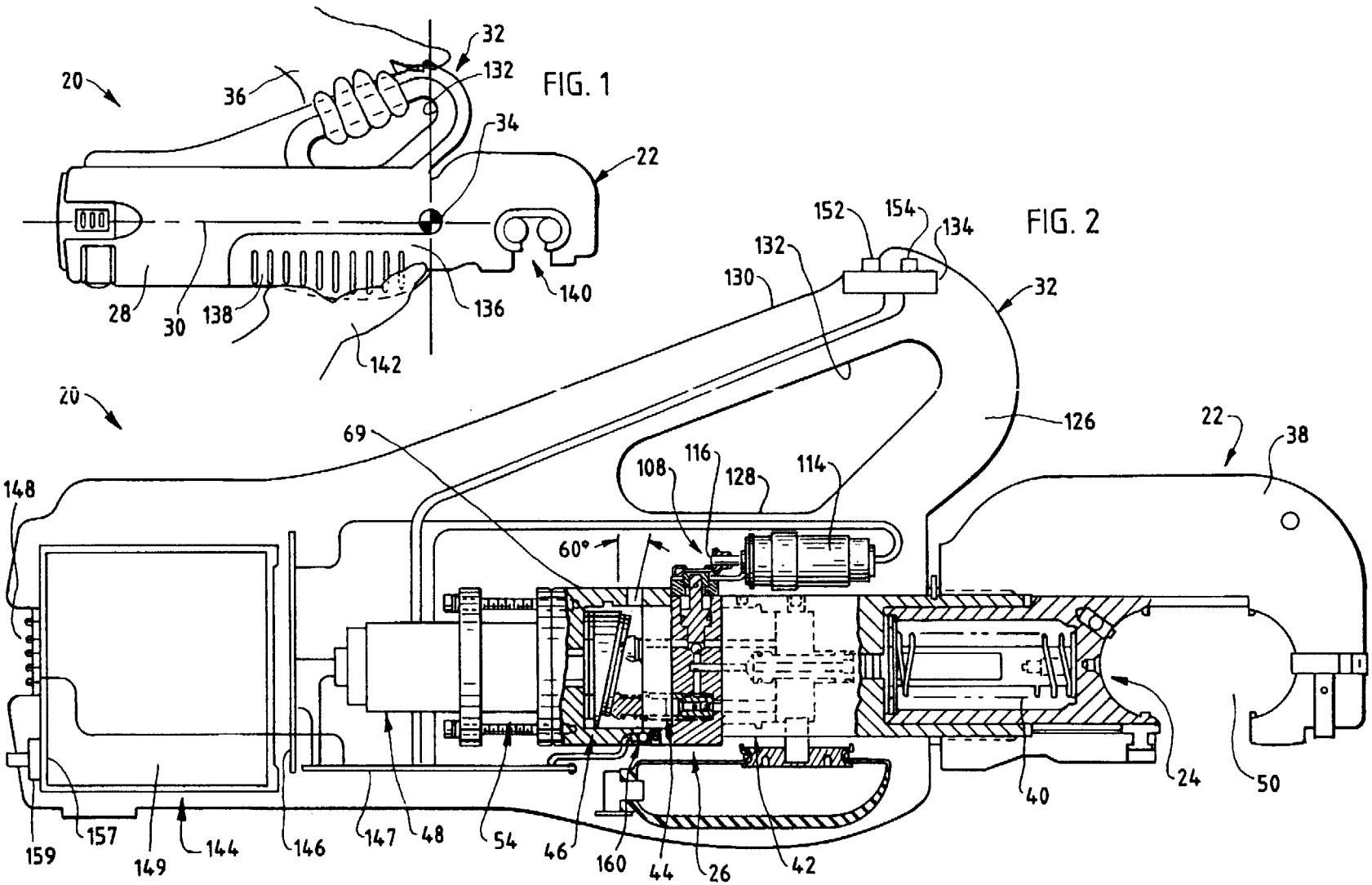
FIG. 1 is a full, external, side elevational view of a crimping apparatus of the present invention shown being held by a handle assembly by an operator and which operator may activate the crimping apparatus and a retract assembly of the crimping apparatus by activation of thumb switches positioned on a upper portion of the handle assembly.
FIG. 2 is a partial fragmentary, cross-sectional, side elevational view of the crimping apparatus as shown in FIG. 1 showing the major sub-assemblies of the crimping apparatus.

While the present invention may be susceptible to embodiment in different forms, there is shown in the drawings, and herein will be described in detail, an embodiment with the understanding that the present description is to be considered an exemplification of the principles of the invention and is not intended to limit the invention to that as illustrated and described herein.

As shown in FIG. 1 and with further reference to FIGS. 2–6, a motor-driven hydraulic crimping apparatus 20 includes a crimper head assembly 22 having a movable hydraulic ram 24 (see FIG. 2). The hydraulic crimping apparatus 20 also includes a hydraulic drive assembly 26 which is coupled to the crimper head assembly 22 as shown generally in FIG. 2 and more specifically in FIGS. 4 and 5. The crimping apparatus 20 is constructed with a crimper body portion 28, housing the hydraulic drive assembly 26. The crimper head assembly 22 is attached to one end of the body portion 28 with the hydraulic drive assembly 26 attached thereto extending oppositely from the head assembly 22 along an axis of an elongation 30 through the body portion 28.

A handle assembly 32 is attached to and extends from the body portion 28. The handle assembly 32 is spaced away from the axis of elongation 30. It should be noted that the crimping apparatus 20 is configured along the axis of elongation 30 with a center of gravity 34 positioned generally between the body portion 28 and the crimper head assembly 22. Lifting, carrying and manipulating the crimping apparatus 20 is easier compared to prior art devices as a result of the handle assembly 32 being positioned generally perpendicular relative to the center of gravity so that the crimping apparatus 20 is balanced and positioned in a natural orientation when a user grips the handle assembly 32. In other words, the crimping assembly 20 is generally balanced in a user's hand 36 with the weight of the crimper head assembly 22 offsetting the weight of the crimper body 28.

Figures 3, 4:
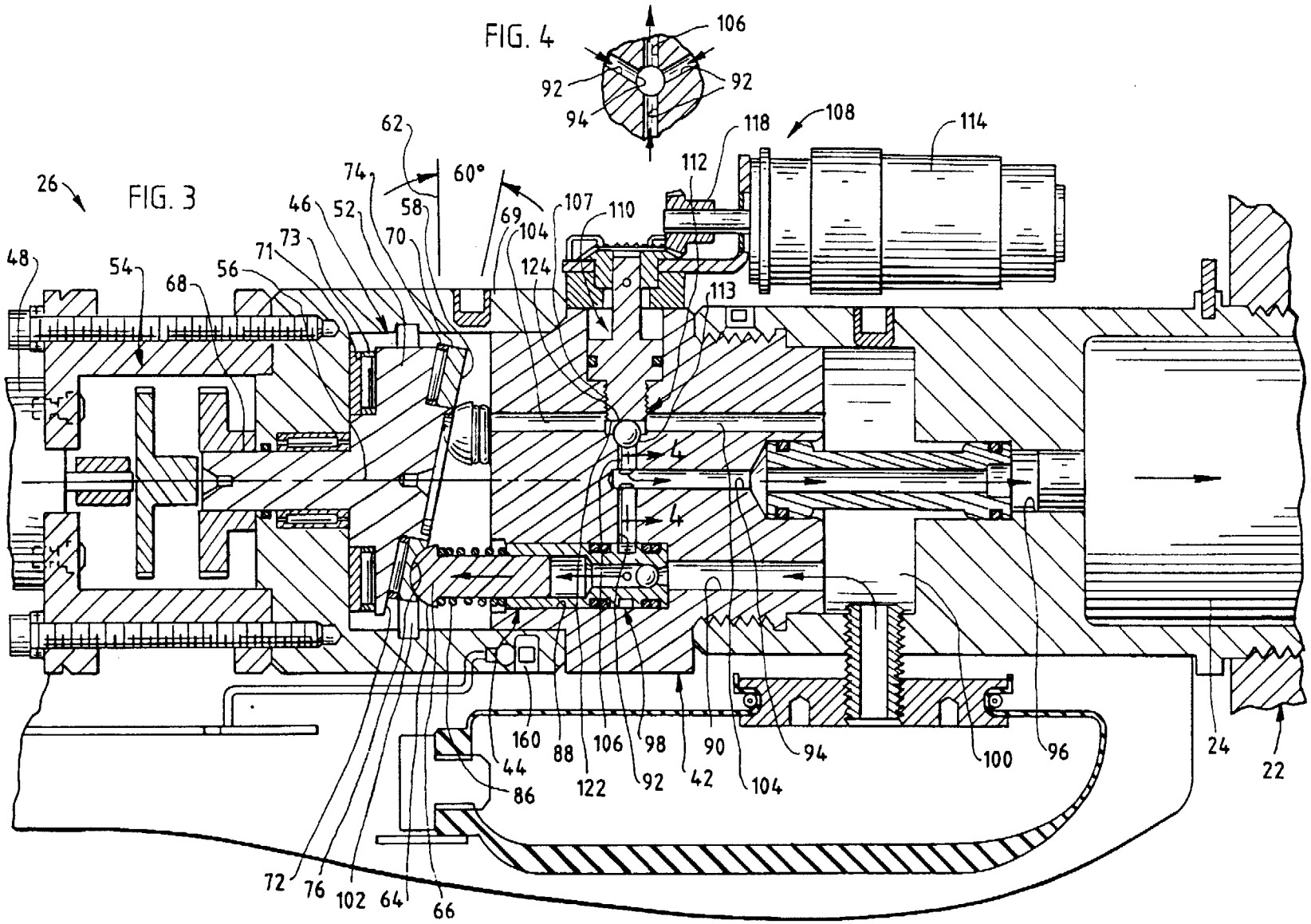
FIG. 3 is an enlarged, partial fragmentary, cross-sectional side elevational view of the crimping apparatus as shown in FIG. 2 in which the apparatus has been operated to drive a ram of the crimping head assembly.
FIG. 4 is a partial fragmentary, cross-sectional view taken along line 4—4 in FIG. 3 showing three flow passages and a drain port connected to a bi-directional passage.
Figure 5:
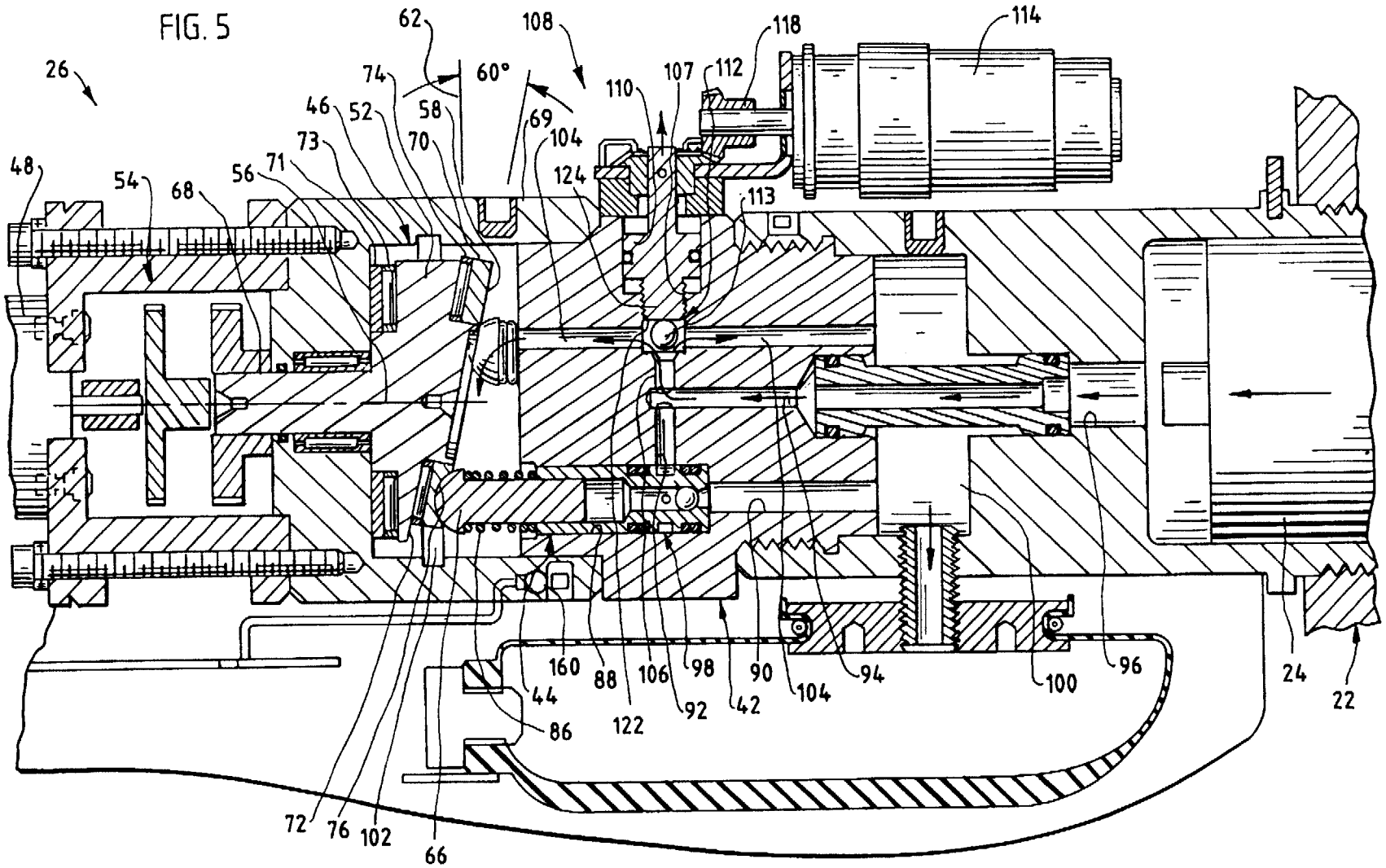
FIG. 5 is an enlarged, partial fragmentary, cross-sectional, side-elevational view of the crimping apparatus similar to that as shown in FIG. 3 in which the apparatus has been operated to retract the ram of the crimp head assembly by operating a retract device to drain hydraulic fluid through the drain port and into reservoirs.

It should be noted that the structure of the body 28 is shown in FIGS. 2, 3, and 5 as an outline of the shape of the body as shown in FIG. 1. The details of the structure of the body 28 have been omitted in the interest of rarity in describing the present invention. The body 28 is preferably injection molded from a suitable polymer material having a surface portion and structures formed therein for attachment to the hydraulic drive assembly 26.

Having briefly described the overall structure and configuration of the present invention, we will now move to a more detailed discussion of the details of the hydraulic drive assembly 26. It should be noted at this point, that the crimper head assembly 22 is of a construction which is generally known in the art having a stationary die portion 38 upon which the movable hydraulic ram 24 operates under the influence of the hydraulic drive assembly 26. A spring loaded retraction mechanism 40 incorporated in the crimper head assembly 22 is of a known construction.

The hydraulic drive assembly 26 includes a hydraulic pump 42 having at least one piston 44 retained therein, a wobble plate assembly 46 which is attached to and driven by a drive motor 48. The hydraulic pump 42 of the hydraulic drive assembly 26 is attached to the crimper head assembly 22 for providing hydraulic forces for moving the hydraulic ram 24 relative to the stationary die 38 to crimp a crimp connection positioned in the mouth 50 of the crimper head assembly 22.

Figure 6:
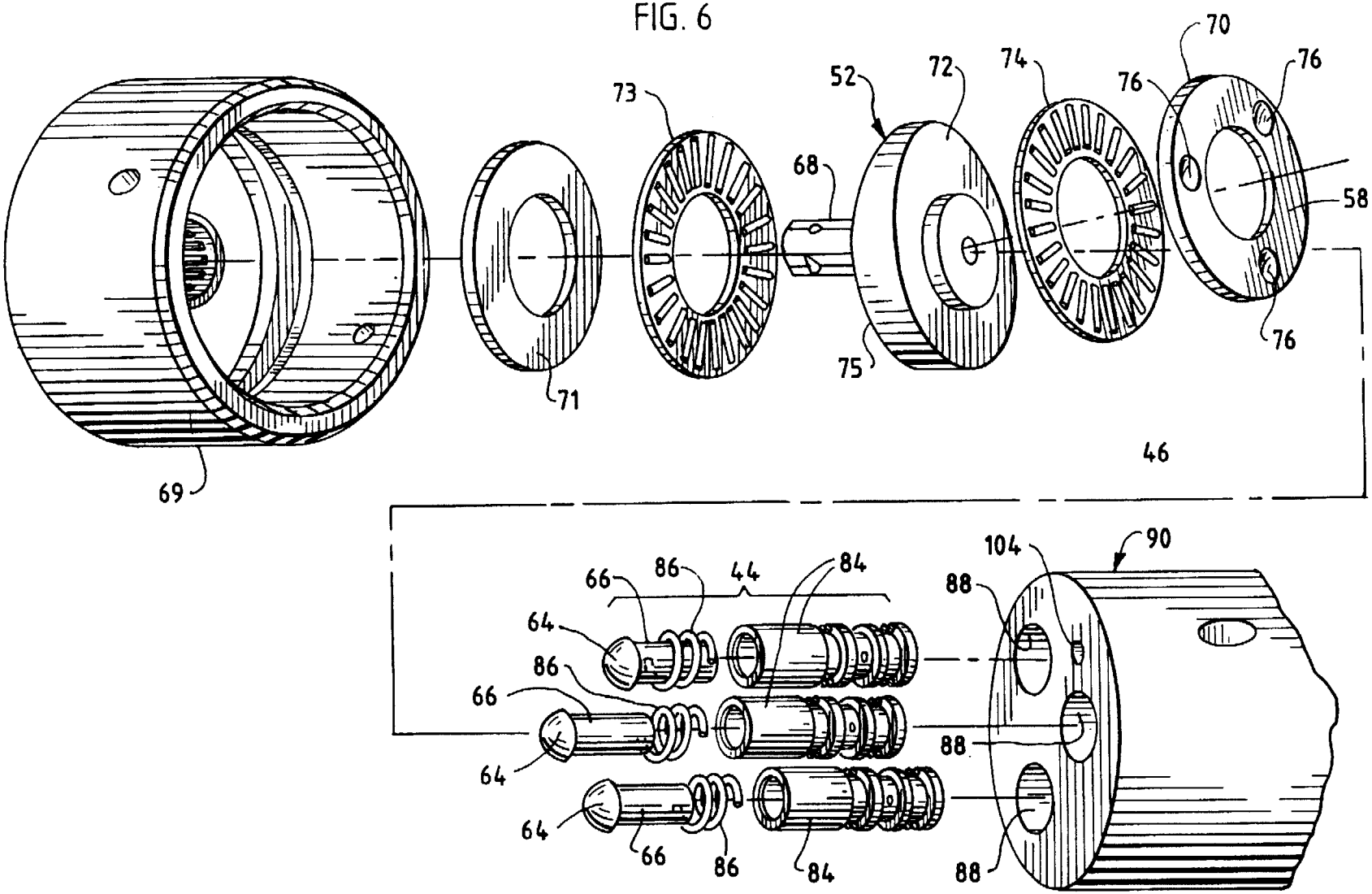
FIG. 6 is an exploded, multiple-perspective view of a portion of the hydraulic drive assembly of the present invention showing an exploded view of a wobble plate assembly and piston cartridges.

With reference to FIGS. 2, 3 and 5 and in particular FIG. 6, the wobble plate assembly 46 includes a wobble drive plate 52 which is connected to the drive motor 48 by a planetary gear 54. The wobble assembly 46 is operated by the drive motor 48 about an axis of rotation 56. A contact surface 58 is disposed at an angle 60 relative to a rotational plane 62 normal to the axis of rotation 56. As shown in FIGS. 3, 5 and 6, the hydraulic pump has three pistons 44 and as shown in FIGS. 3 and 5, the heads 64 of the pistons 44 abut the contact surface 58.

An important feature of the present invention is that the contact surface 58 of the wobble assembly 46 is retained against rotation about the axis of rotation 56. When the wobble plate 52 is rotated about the axis of rotation 56, the non-rotating contact surface 58 translates a periodic movement which generally linearly reciprocates a plunger portion 66 of each of the pistons 44. In other words, the contact surface "wobbles" relative to the axis of rotation without rotating. The linear motion occurs at a position spaced away from the axis of rotation 56 and along a path which is generally parallel to the axes of rotation 56 and elongation 50. This configuration is important in order to provide the axially elongated configuration of the hydraulic drive assembly 26 along the axis of elongation 30. The axially elongated configuration provides a linear displacement of the crimper body 28 along the axis of elongation 30 away from the crimper head assembly 22 balance the weight of the crimper head assembly 22 generally at the center of gravity 34.

The wobble assembly 46 is shown in FIG. 6 in an exploded perspective view in order to illustrate the arrangement of the numerous components of the wobble assembly 46 and the cartridge construction of the pistons 44. As noted above, the wobble assembly 46 includes the wobble plate 52 which has a shaft 68 which is coupled to the motor 48 by the planetary gear 54. A housing or adapter 69 connects to the planetary gear 54 and has a thrust washer 71 and thrust bearing 73 positioned therein and abutting a rear surface 75 of the wobble plate 52. The contact surface 58 is disposed on a wobble ring 70 which is positioned over a working face 72 of the wobble plate 52. It is the working face 72 of the wobble plate 54 that is disposed at an angle 60 relative to the axis of rotation 56. A thrust beating 74 is positioned between the working face 72 of the wobble plate 52 and the wobble ring 70 for facilitating rotation of the wobble plate 52 relative to the wobble ring 70 while the wobble ring 70 is retained against rotation relative to the axis of rotation 56.

A plurality of sockets 76 are formed in the contact surface 58 to cooperatively engage the heads 64 of the corresponding pistons 44. The heads 64 of the plungers 66 have a convex arcuate surface while the sockets 76 in the contact surface 58 have concave arcuate surfaces which are dimensioned to cooperatively engage the convex arcuate heads 64. The plungers 66 only move linearly and parallel to the axis of rotation 56 and therefore resist the rotary movement of the wobble plate 52. The sockets 76 mate with the heads 64 to further retain the wobble ring 70 in a fixed position. Retention of the wobble ring 70 against rotation is important in order to reduce the mount of wear that might otherwise be created by the rotation of a wobble ring contact surface 58 against the heads 64 of the pistons 44. Only nominal movement occurs between the piston head 64 and the corresponding recess 76 thereby further minimizing any wear which might be caused by this engagement and operation. As a result of the present configuration, rotary motion of the wobble plate 52 is translated into reciprocal linear motion of the pistons 44. The motion of the pistons 44 pressurize the hydraulic fluid and the pump 42 to drive the ram 24.

Referring to FIG. 6, it can be seen that the pistons 44 are a cartridge assembly which includes the plunger 66, and a spring 86 telescopically stacked in a bushing 84. The plunger 66 and spring 86 are retained in the bushing 84 which is positioned in a corresponding cylinder bore 88 of a pump housing 90 of the hydraulic pump 42. With further reference to FIGS. 2–5, it can be seen that the cylinder bores 88 communicate with inlet passages 90 and flow passages 92. With reference to FIG. 4, the flow passages 92 communicate with a bi-directional passage 94 through which hydraulic fluid is forced and which communicates with a drive chamber 96.

Each of the pistons 44 includes a one-way check valve 98 positioned between the inlet passage 90 and the flow passage 92 through which hydraulic fluid passes from a first reservoir 100. A second reservoir 102 is provided in the drive assembly 26 which surrounds the wobble plate 52 of the wobble plate assembly 46 and is contained by the housing 69. A drain passage 104 connects the first and second reservoirs 100, 102 and communicates with a drain port 106 which communicates with the bi-directional passage 94.

A retract device 108 is coupled to the hydraulic pump 42 to controllably retract the hydraulic ram 24. The retract device 108 includes a release valve 110 coupled to the hydraulic pump 42 and communicating with the drain passage 104 and drain port 106. The release valve 110 is threadedly engaged with the hydraulic pump 42 to controllably operate a one-way ball valve 112. When a ball 113 of the ball valve 112 is disengaged from the drain port 106 hydraulic fluid drains from the bi-directional passage 94, through the drain port 106, through the drain passage 104 and into the reservoirs 100, 102.

A retract motor 114 operates the release valve 110 by way of a bevel gear assembly 116 having a pair of a bevel gears 118, 120 attached to the motor 114 and the release valve 110, respectively. When the retract device 108 is activated, the motor 114 operates the bevel gears 116 to drive the release valve 110 thereby opening the drain port 106. Further discussion of the retract device 108 will be provided hereinbelow with the discussion of the operation of the crimping apparatus 20.

It should also be noted that the motor 114 is oriented perpendicular to the release valve 110 in order to further promote the elongated configuration of the crimping apparatus 20. By positioning the motor 114 perpendicular to the release valve 110 and using a bevel gear assembly 116, the motor 114 can be oriented axially generally parallel to the axis of elongation 30 while driving the release valve 110 generally perpendicular to the axis of elongation 30.

The retract device 108 and the associated drain port 106 and drain passage 104 provide further advantages in operating the present invention. When the retract device 108 is operated, hydraulic fluid flows through the drain port 106 and the drain passage 104. The flow capacity through the drain port 106 and the drain passage 104 is greater than the pressurizing capacity of the flow passages 92. Generally, only one piston 44 will be pressurizing hydraulic fluid at any given time during a crimping cycle. As such, the larger capacity drain passage 104 will drain the drive chamber 96 when the retract device 108 is activated at a faster rate than the pistons 44 can drive hydraulic fluid to the drive chamber 96. This feature is useful during a retract mode in order to prevent continued crimping once the retract device 108 has been activated. Additionally, even after the release valve 110 is seated to block the drain port 106, hydraulic fluid may pass through the drain passage 104 between the reservoirs 100, 102 to equalize the pressure therein. Flow through the drain passage 104 between the reservoirs 100, 102 is facilitated by a clearance gap 122 between a head 124 of the release valve 110 and the drain passage 104.

Turning now to the structure and configuration of the handle assembly 32 as shown in FIGS. 1 and 2, the handle assembly 32 includes an attachment portion 126 extending from a dorsal side 128 of the crimper body 28 and a grip area or gripping portion 130 extending from and attached to the attachment portion 126 and the dorsal side 128. The attachment portion 126 of the handle assembly 32 extends forwardly from the crimper body 28 towards the crimp head assembly 22 with the gripping portion 130 angling rearwardly from the attachment portion 126 and connecting to the crimper body 28 at a position spaced away from the attachment portion 126. Additionally, the configuration of the present handle 32 places a control switch 134 on an upper surface of the gripping portion 130 of the handle 32. With reference to FIG. 1, the handle assembly 32 allows a user to grip the apparatus 20 by inserting his palm and four fingers at least partially through a gripping opening 132. The control switch 134, being positioned on the upper surface of the gripping portion 130, is operated by the thumb of the operator. This gripping arrangement results in a secure grip on the handle and comfortable control of the switch 134.

The "forwardly raked" handle 32 configuration provides an enlarged gripping aperture 132 between the gripping portion 130 and the attachment portion 126. In the present configuration, the gripping portion 130 and attachment portion 126 have been arranged to provide an aperture 132 having sufficient size and dimension to accommodate the hand of an operator which may be covered in a heavy duty insulating glove. This is an important consideration since a user of the present invention may be wearing insulating gloves in order to perform a crimp operation on electrical conductors.

The structure of the handle 32 is important to the present invention since it positions the gripping portion 130 and control switch 134 generally over the center of gravity 34 thereby facilitating a comfortable lifting grip and easier lifting. The angle of the gripping portion 130 is configured for ergonomic comfort for an operator who must repetitively lift, position, operate and remove the crimping apparatus. This is important since the crimping apparatus may be quite heavy, in the range of 10–20 pounds. The placement of the switch 134 on the upper surface of the handle 32 helps prevent inadvertent operation of the crimper when it is gripped and lifted. In contrast, prior art devices locate the trigger or control switch on the body in a position which is conducive to inadvertent activation. Inadvertent activation may pose a safety problem as well as producing an unnecessary drain on the battery. Therefore, the present invention eliminates safety problems and wasted battery power. It should be recognized that a variety of handle configurations could be provided to achieve the desirable structural and functional characteristics of the handle configuration 32 of the present invention.

The present invention also includes a friction grip 136 positioned on an undersurface 138 of the crimper body 28. This friction grip 136 provides an additional grip and support area to be used in conjunction with the handle assembly 32. Generally, an operator will lift, manipulate, position and remove the crimper 20 by use of the handle assembly 32. But where circumstances require, the friction grip 136 on the undersurface 138 may be gripped by the free hand. The friction grip 136 is positioned opposite the handle assembly 32 at a similar location relative to the center of gravity 34. This opposed orientation of the handle assembly 32 and friction grip 136 helps to improve the gripping and ease of movement of the apparatus 20.

Figure 7:
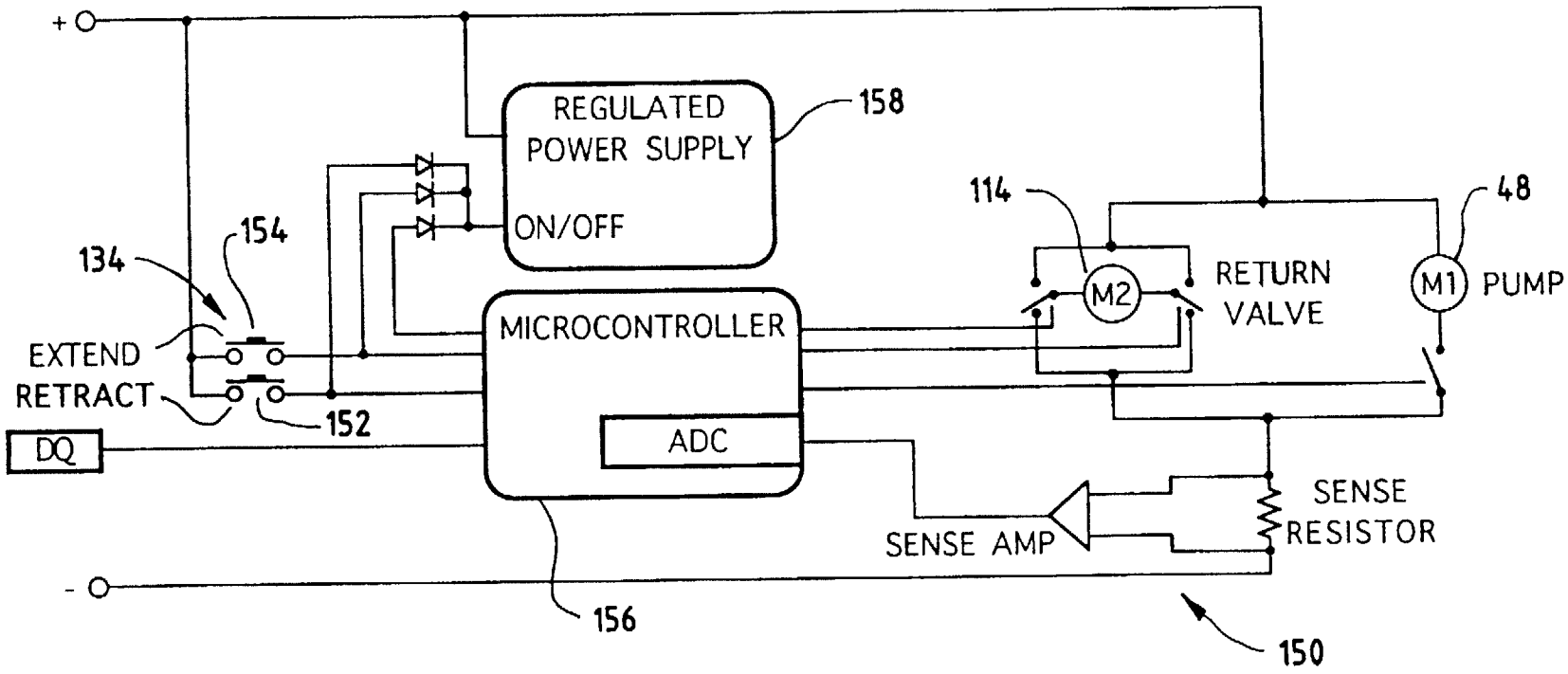
FIG. 7 is a general schematic of the crimping apparatus.
Figure 8:
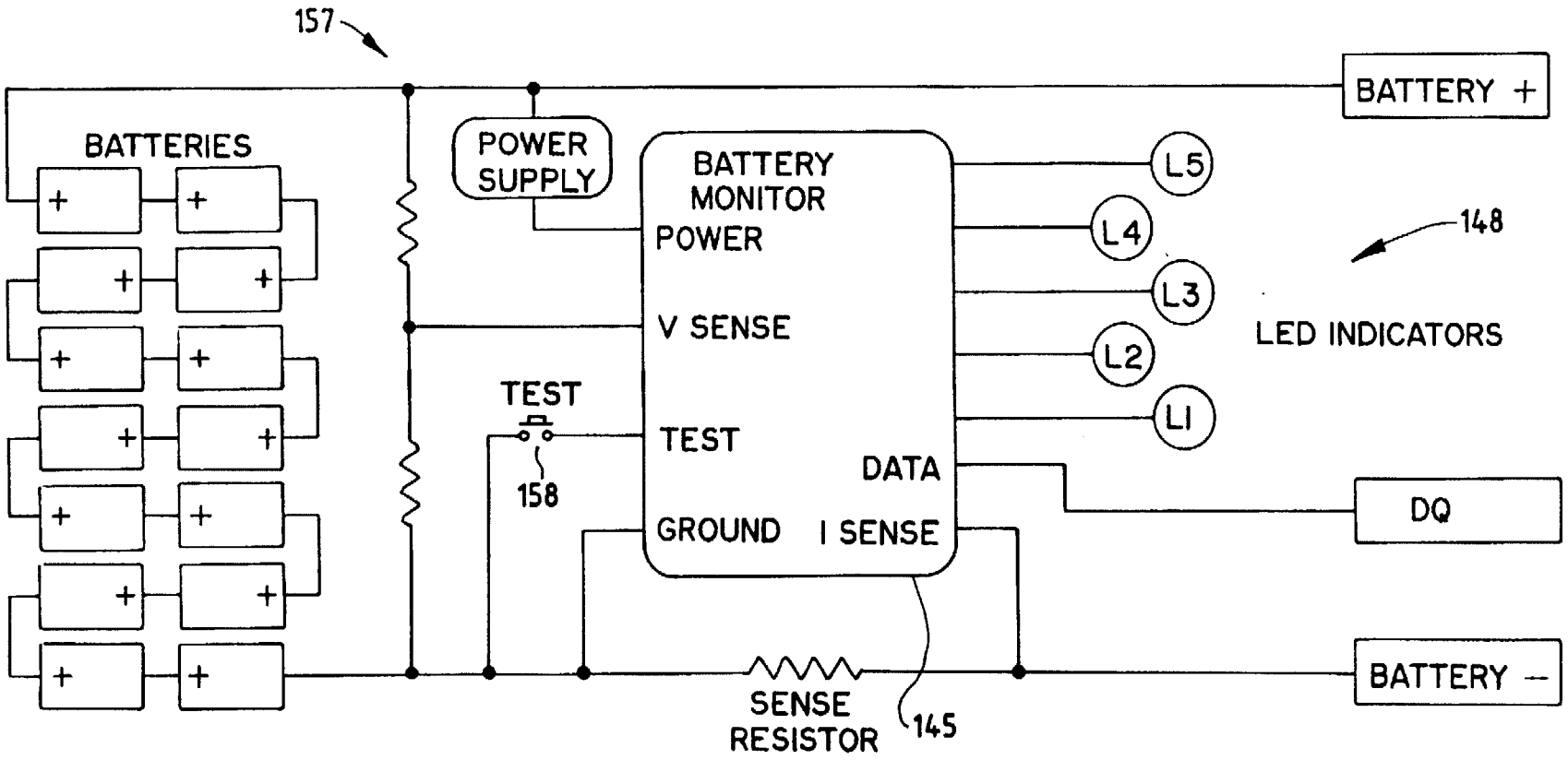
FIG. 8 is a schematic of a battery interrogation circuit of the present invention.

Turning now to the overall operation of the present invention, reference is made to FIGS. 1–8 and in which FIG. 7 provides a general schematic of the crimping apparatus and controlling circuit and FIG. 8 provides a schematic of a battery monitoring circuit of the present invention.

In use, an operator employs the crimping apparatus 20 of the present invention by gripping the gripping portion 130 of the handle 32 with a palm and four fingers with the thumb resting over the control switch 134. The axially elongated configuration of the present invention provides a balanced arrangement when picking up the apparatus 20 by the handle 32 in order to minimize the effort and strain involved in lifting the apparatus as well as providing accuracy in placing the crimper head assembly 22 of the apparatus on a crimp connection or article 140 as shown in FIG. 1. If necessary, the friction grip 136 on the under surface 138 of the crimper body 28 may be gripped by a second hand 142.

Once the crimper 20 is placed on a crimp connection 140, the operator holding the apparatus 20 by the handle assembly 32 activates the control switch 134 to initiate a crimp cycle. A crimp cycle includes driving the movable hydraulic ram 24 forwardly generally along the axis 50 to compressively crimp the crimp connection against the stationary die 38. Once the crimp is completed, the ram 24 is automatically retracted a predetermined distance to release the ram 24 and die 38 from the crimp connector. The crimper 20 is then moved to the reset position along the crimp connector and activated. The operator also may manually activate the retract switch to retract the ram 24 completely for placement on the next crimp connector.

A battery pack 144 is provided which includes batteries 149 and a circuit board 157 (see FIG. 8). The battery pack circuit board 157 includes a battery monitoring integrated circuit 145 which can be interrogated by the microcontroller 156, LED indicators 148 to display the battery status to the operator, and a "test" switch 159 to activate the indicators. When the "test" switch 158 is pressed, the LED indicators 148 are selectively illuminated to provide a representative indication as to the charge in the battery pack 144. A printed circuit board assembly 146 is provided which includes a microcontroller 156 to control the overall operation of the crimping apparatus 20. The microcontroller 156 interrogates the battery pack 144 for battery status to determine whether there is sufficient charge in the battery pack 144 to complete a crimp cycle before starting the crimp cycle. The microcontroller 156 is coupled to the motors 48, 114, switches 152, 154 and temperature sensing device 160, and has programming to control the operation of the crimper.

The temperature sensing device 160 is in the form of a thermistor and is used to sense the temperature of the oil (hydraulic fluid) in the hydraulic drive assembly 26. The temperature sensing device 160 is coupled to the microcontroller 156 which reads the temperature sensing device 160 and adjusts the current limit to keep the crimp force constant over changes in oil viscosity.

In order to further preserve the battery of the present invention, a regulated power supply 158 is connected to the operation circuit 150 of the invention as shown in FIG. 7. When the crimper is not in use, the regulated power supply 158 is turned off which drops the battery drain current to near zero. When the control switch 134 is activated by activating either an extend switch 154 or a retract switch 152, the power supply 158 is turned on. The extend switch 154 operates the hydraulic drive assembly 26 to advance the ram 24. The retract switch 152 operates the retract device 108 to retract the ram 24.

When the extend switch 154 is activated, the battery 144 is interrogated by the circuit 146 for the remaining capacity. The remaining capacity is compared to a predetermined minimum threshold stored in the microprocessor 145. If there is insufficient charge remaining in the battery to complete a crimp cycle, then the crimp operation is terminated by the microprocessor 156. If there is sufficient charge, microprocessor 156 allows the drive motor 48 to be energized. When the extend switch 154 is released, the drive motor 48 is deenergized. If the extend switch 154 is held, the motor 48 is energized to drive the ram 24. When the motor current exceeds a predetermined threshold, as sensed by the microcontroller 152, (indicating that the crimp is complete) or when the run time exceeds a predetermined threshold, as timed by the microprocessor 156, (indicating a failure), the microcontroller 152 deenergizes the motor 48. If the crimp completes successfully, the microcontroller 156 automatically opens and closes the release valve 110 by operation of the retract motor 114 to retract the ram 24 a sufficient distance to allow the crimper head to be repositioned along the crimp connector.

It should be noted that the ram 24 in this condition will not fully retract but only retract a sufficient distant to disengage the prior crimp and provide clearance to slide the crimp head 22 along the crimp connector to the next crimp position. The ram 24 can be fully retracted by pressing and holding the retract switch 152. Pressing and holding of the retract switch 152 will operate the retract device 108 to fully open the release valve 110 and maintain it in the open condition thereby allowing the hydraulic fluid to drain from the drive chamber 96 into the reservoirs 100, 102 until the retract switch 152 is released.

The retract switch 152 takes precedent in the programming in the microcontroller 156 over the extend switch 154. The extension or driving portion of the crimp cycle will not be initiated while the retract switch 152 is held. Further, once the crimping cycle has been initiated, operation of the retract switch 152 will halt the forward advancement of the ram 24 and start the retract cycle. If the extending portion of the crimp cycle is interrupted for any reason, the extend switch 154 must be released and then depressed to restart the extend portion of the crimp cycle. The microcontroller 156 acts to further conserve battery power by deactivating the regulated power supply 158 if both switches 154, 152 are released. The microcontroller 156 has a predetermined time out of several seconds after which the power supply is deactivated.

While a preferred embodiment of the present invention is shown and described, it is envisioned that those skilled in the art may devise various modifications and equivalents without departing from the spirit and scope of the appended claims. The invention is not intended to be limited by the foregoing disclosure.

The invention claimed is:

1. A hydraulic crimping apparatus comprising:

a crimper head assembly having a moveable, single acting hydraulic ram;

a hydraulic drive assembly coupled to said crimper head assembly;

said hydraulic drive assembly including a hydraulic pump having at least one piston retained therein coupled to a drive motor;

said hydraulic pump being coupled to said crimper head assembly for providing hydraulic forces for moving said hydraulic ram of said crimper head assembly;

a retract device coupled to said hydraulic pump for controllably retracting said hydraulic ram, said retract device including a release valve coupled to said hydraulic pump for controllably draining hydraulic fluid from said hydraulic pump to retract said hydraulic ram; and a control circuit and a retract switch coupled to said retract device, said retract switch having at least two operating modes, a first mode which signals said control circuit to momentarily operate said release valve to incrementally retract said hydraulic ram, and a second mode which signals said control circuit to operate said release valve to selectively retract said hydraulic ram.

2. A hydraulic crimping apparatus as recited in claim 1, said wobble assembly further comprising:

a wobble plate connected to said drive motor, said wobble plate having a working face disposed at an angle relative to said axis of rotation; and a wobble ring positioned between said working face and said at least one piston with said contact surface disposed on said wobble ring abutting said piston and being retained against rotation of said wobble plate for translating rotary motion of said working face into generally linear reciprocal motion at a position radially spaced from and generally parallel to said axis of rotation to drive said at least one piston.

3. A hydraulic crimping apparatus as recited in claim 2, said contact surface of said wobble ring having a socket thereon corresponding to each one of said at least one pistons for cooperatively engaging said piston.

4. A hydraulic crimping apparatus as recited in claim 3, further comprising:

each of said at least one piston including a plunger having a head with a convex arcuate surface; and each of said sockets on said wobble ring having a cooperatively formed concave arcuate surface for facilitating relative motion of said head of said plunger against said concave arcuate surface of said socket.

5. A hydraulic crimping apparatus as recited in claim 2, further comprising: a thrust bearing positioned between said working face of said wobble plate and said wobble ring for facilitating rotation of said wobble plate relative to said wobble ring with said wobble ring being retained against rotation relative to said axis of rotation.

6. A hydraulic crimping apparatus as retired in claim 1, said hydraulic drive assembly further comprising: a bi-directional passage extending from said hydraulic pump to said crimper head assembly, pressurized hydraulic fluid from said hydraulic pump passing through said bi-directional passage to drive said hydraulic ram of said crimper head assembly and draining from said crimper head assembly through said passage to said pump.

7. A hydraulic crimping apparatus as recited in claim 6, further comprising: a retract device coupled to said hydraulic pump for controllably retracting said hydraulic ram; and said retract device including a release valve coupled to said hydraulic pump and communicating with said bi-directional passage for controllably draining hydraulic fluid from said pump to retract said hydraulic ram.

8. A hydraulic crimping apparatus as retired in claim 7, further comprising: a control circuit and a retract switch coupled to said retract device, said retract switch having at least two operating modes, a first mode which signals said control circuit to momentarily operate said release valve to incrementally retract said hydraulic ram, and a second mode which signals said control circuit to operate said release valve to selectively retract said hydraulic ram.

9. A hydraulic crimping apparatus as recited in claim 7, further comprising:

a drain passage communicating with said bi-directional passage and said retract device and being regulated by said retract device coupled to said hydraulic pump, said drain passage being dimensioned for providing a greater flow capacity than said pistons to prevent continued driving of said hydraulic ram after activating the retract device.

10. A hydraulic crimping apparatus as recited in claim 1, further comprising:

said hydraulic crimping apparatus being arranged in a generally linear configuration along an axis of elongation;

said crimper head assembly being positioned at one end of said axis of elongation with said hydraulic drive assembly being axially arranged along said axis of elongation extending away from said crimper head assembly; and a handle of said hydraulic crimping apparatus spaced away from said axis of elongation.

11. A hydraulic crimping apparatus as recited in claim 10, further comprising:

a control switch for operating said hydraulic drive assembly to move said ram of said crimper head assembly, said control switch being positioned on said handle spaced away from said axis of elongation generally perpendicular to a center of gravity of said hydraulic crimping apparatus.

12. A method of crimping a crimp article employing a hydraulic crimping apparatus including a crimp head assembly having a single acting movable hydraulic ram; a hydraulic drive assembly coupled to said crimper head assembly for providing hydraulic forces for moving said hydraulic ram, said hydraulic drive assembly having a hydraulic pump including a drive motor coupled to said crimper head assembly for providing hydraulic forces for moving said hydraulic ram of said crimper head assembly; a control circuit including a microcontroller for controllably operating said hydraulic drive assembly; and a retract device coupled to said hydraulic pump for controllably retracting said hydraulic ram, said retract device including a controllable release valve coupled to said hydraulic pump and a retract motor coupled to said release valve and to said control circuit for controllably operating said release valve to controllably drain hydraulic fluid from said hydraulic pump to retract said hydraulic ram, and to controllably operate said release valve to prevent flow of hydraulic fluid from said hydraulic pump, said method comprising the steps of:

positioning said crimper head assembly on a crimp article;

operating said control circuit to actuate said hydraulic drive assembly for moving said hydraulic ram against said crimp article to impose crimping forces thereon;

sensing an increased load on said drive motor with said microcontroller;

sensing a current limit in the drive motor with said microcontroller;

said control circuit and said microcontroller controllably operating said retract motor to drive said release valve to a predetermined condition for draining hydraulic fluid from said hydraulic pump for a predetermined period of time;

control circuit and said microcontroller controllably driving said retract motor to operate said release valve to reengage said release valve to prevent further drag of hydraulic fluid, operation of said release device partially retracting said ram a predetermined limited distance to allow the crimper head assembly to be repositioned along said crimp article without fully retracting said hydraulic ram.

13. A method of crimping a crimp article as recited in claim 12, further comprising:

sensing the remaining charge in a battery used to energize said hydraulic crimp assembly;

comparing the sensed charge remaining in the battery to a predetermined charge which is required to complete a crimp cycle;

activating said hydraulic drive assembly upon sensing a sufficient charge to complete a crimp cycle.

14. A hydraulic crimping apparatus comprising:

a body portion having a generally elongated configuration extending along an axis of elongation;

a crimper head assembly extending from one end of said body portion;

a hydraulic drive assembly retained in said body portion being axially configured along said axis of elongation and coupled to said caper head assembly;

said hydraulic drive assembly including a hydraulic pump having a plurality of pistons therein and a wobble assembly attached to a drive motor, said hydraulic pump being coupled to said crimper head assembly for providing hydraulic forces to move a single acting hydraulic ram of said crimper head assembly;

said drive motor controllably operating said wobble assembly relative to an axis of rotation, said wobble assembly having a contact surface disposed at an angle relative said axis of rotation with said plurality of pistons abutting said contact surface and with said contact surface being retained against rotation relative to said axis of rotation, operation of said wobble assembly by said drive motor moving said plurality of pistons generally parallel to said axis of elongation, reciprocal movement of said pistons of said hydraulic pump pressurizing hydraulic fluid to operate said crimper head assembly;

a retract device coupled to said hydraulic pump for controllably retracting said hydraulic ram, said retract device including a release valve coupled to said hydraulic pump for controllably draining hydraulic fluid from said hydraulic pump to retract said hydraulic ram; and a control circuit and a retract switch coupled to said retract device, said retract switch having at least two operating modes, a first mode which signals said control circuit to momentarily operate said release valve to incrementally retract said hydraulic ram, and a second mode which signals said control circuit to operate said release valve to selectively retract said hydraulic ram.

15. A hydraulic crimping apparatus as recited in claim 14, further comprising:

a wobble plate connected to said drive motor, said wobble plate having a working face disposed at an angle relative to said axis of rotation;

a wobble ring positioned between said working face and said at least one piston with said contact surface disposed on said wobble ring abutting said piston and being retained against rotation of said wobble plate for translating rotary motion of said working face into generally linear reciprocal motion at a position radially spaced from and generally parallel to said axis of rotation to drive said at least one piston.

16. A hydraulic crimping apparatus as recited in claim 15, said contact surface of said wobble ring having a socket therein corresponding to each one of said plurality of pistons for cooperatively engaging each of said pistons;

each of said plurality of pistons including a plunger which has a head with a convex arcuate surface; and each of said sockets on said wobble ring having a cooperatively formed concave arcuate surface for facilitating relative motion of said head of said plunger against said concave arcuate surface of said socket.

17. A hydraulic crimping apparatus as recited in claim 15, further comprising:

a thrust beating positioned between said working face of said wobble plate and said wobble ring for facilitating rotation of said wobble plate relative to said wobble ring while said wobble ring is positioned against rotation relative to said axis of rotation.

18. A hydraulic crimping apparatus as recited in claim 14, further comprising:

a control circuit and a retract switch coupled to said retract device, said retract switch having at least two operating modes, a first mode which signals said control circuit to momentarily operate said release valve to incrementally retract said hydraulic ram, and a second mode which signals said control circuit to operate said release valve to selectively retract said hydraulic ram.

19. A hydraulic crimping apparatus as recited in claim 14, further comprising:

a handle depending from said body portion of said hydraulic crimping apparatus spaced away from said axis of elongation, said handle having an attachment portion and a gripping portion, said attachment portion generally extending from a dorsal side of said body portion with said gripping portion connected thereto, a gripping opening being defined between said gripping portion and a portion of said dorsal side of said body portion; a control switch for operating said hydraulic drive assembly to control said crimper head assembly, said control switch being positioned on an upper surface of said gripping portion of said handle, said gripping portion of said handle being oriented for gripping by the palm and fingers of a user extending at least partially through said gripping opening with said control switch being oriented for operation by a thumb of the operator.

20. A hydraulic crimping apparatus as recited in claim 1, further comprising a wobble assembly attached to said drive motor, said drive motor controllably operating said wobble assembly relative to an axis of rotation, said wobble assembly having a contact surface disposed at an angle relative said axis of rotation with said at least one piston abutting said contact surface and with said contact surface being retained against rotation relative to said axis of rotation; and operation of said wobble assembly by said drive motor moving said at least one piston generally parallel to said axis of rotation, reciprocal movement of said piston in said hydraulic pump pressurizing hydraulic fluid to operate said crimper head assembly.

* * * * *

UNITED STATES PATENT AND TRADEMARK OFFICE

CERTIFICATE OF CORRECTION

PATENT NO. : 5,727,417

DATED : March 17, 1998

INVENTOR(S) : W. Keith Moffatt, Billy J. Bauscher and Richard A. Zwicky, Jr.

It is certified that error appears in the above-indentified patent and that said Letters Patent is hereby corrected as shown below:

Column 4, Line 31 "rarity" should be -- clarity --

Column 5, Line 29 "beating" should be -- bearing --

Column 10, Line 35 "retired" should be -- recited --

Column 10, Line 51 "retired" should be --recited --

Column 11, Line 55 "drag" should be -- draining --

Column 12, Line 11 "caper" should be -- crimper --

Column 13, Line 3 "beating" should be --bearing --

Signed and Sealed this

Fifteenth Day of September, 1998

*Attest:*

Bruce Lehman

BRUCE LEHMAN

*Attesting Officer*

*Commissioner of Patents and Trademarks*